US007513227B1

(12) United States Patent
Ogawa et al.

(10) Patent No.: US 7,513,227 B1
(45) Date of Patent: Apr. 7, 2009

(54) VALVE TIMING CONTROL DEVICE

(75) Inventors: Kazumi Ogawa, Toyota (JP); Mitsuru Uozaki, Frankfurt am Main (DE)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 315 days.

(21) Appl. No.: 11/649,820

(22) Filed: Jan. 5, 2007

(30) Foreign Application Priority Data

Jan. 10, 2006 (JP) ..... 2006-002312

(51) Int. Cl.
*F01L 1/14* (2006.01)

(52) U.S. Cl. ..... 123/90.15; 123/90.13; 123/90.17; 123/90.31; 123/347; 137/625.69; 251/129.15; 464/160

(58) Field of Classification Search ..... 123/90.12, 123/90.13, 90.15, 90.16, 90.17, 90.27, 90.31, 123/347, 348; 251/12, 129.01, 129.15; 464/1, 464/2, 160; 137/625, 625.69
See application file for complete search history.

(56) References Cited

U.S. PATENT DOCUMENTS 7,225,775 B2 * 6/2007 Ogawa ..... 123/90.17

FOREIGN PATENT DOCUMENTS

JP 2003-278566 A 10/2003

* cited by examiner

*Primary Examiner*—Ching Chang
(74) *Attorney, Agent, or Firm*—Buchanan Ingersoll & Rooney PC

(57) ABSTRACT

A valve timing control device includes a driving side rotational member, a driven side rotational member, a retarded angle chamber, an advanced angle chamber, a first control valve, a supply passage supplying the fluid to the first control valve, a first pump pumping the fluid to a vapor liquid separating portion, a second pump pumping the fluid in the vapor liquid separating portion to the first control valve, a discharge passage discharging the fluid from the first control valve toward the operational fluid reservoir, and a second control valve provided at the discharge passage and operated to switch the discharge passage between a first discharge passage is discharging the fluid discharged from the first control valve to the operational fluid reservoir and a second discharge passage flowing the fluid to be drawn into the first pump.

6 Claims, 5 Drawing Sheets

VALVE TIMING CONTROL DEVICE

CROSS REFERENCE TO RELATED APPLICATIONS

This application is based on and claims priority under 35 U.S.C §119 with respect to Japanese Patent Application 2006-002312, filed on Jan. 10, 2006, the entire content of which is incorporated herein by reference.

FIELD OF THE INVENTION

This invention relates to a valve timing control device. More particularly, this invention relates to a valve timing control device which includes a driving side rotational member synchronously rotating relative to a crankshaft of an internal combustion engine, a driven side rotational member positioned coaxially to the driving side rotational member and rotatable relative to the driving side rotational member, the driven side rotational member synchronously rotating relative to a camshaft for opening and closing valves of the internal combustion engine, a retarded angle chamber formed by the driving side rotational member and the driven side rotational member and displacing a relative rotational phase of the driven side rotational member relative to the driving side rotational member in a retarded angle direction, an advanced angle chamber displacing the relative rotational phase in an advanced angle direction, and a first change valve controlling the supply and the discharge state of an operational fluid among the advanced angle chamber, the retarded angle chamber and an operational fluid reservoir provided at a lower portion of the internal combustion engine.

BACKGROUND

A valve timing control device operates in synchronization with a crankshaft and a camshaft of an engine, which is an internal combustion engine. A relative rotational phase of the valve timing control device can be changed or set by control of the relative rotational position between an advanced angle chamber and a retarded angle chamber, which are provided between the driven side rotational member and the driving side rotational member respectively. Then, a preferable operating state can be attained by properly setting the relative rotational phase in response to an operating state of the engine.

A hydraulic pump supplies and discharges an operational fluid to fluid pressure chambers of the valve timing control device and is driven by the crankshaft of the engine. Thus, while the engine is driven, the operational fluid is supplied into the fluid pressure chambers by the hydraulic pump. Thus, the control of the relative rotational position is performed smoothly.

On the other hand, while the engine is stopped, the hydraulic pump is not driven, and thus the operational fluid flows out from the fluid pressure chambers by its own weight.

Therefore, the operational fluid is reserved in an oil pan, and the temperature of the oil is low at the start of the engine. In this state, viscosity of the operational fluid is high, and resistance of the flow passage is large. Consequently, it is time-consuming to supply the operational fluid to the fluid pressure chambers via an oil passage of an oil pressure circuit. For the reason, it is difficult to smoothly control the relative rotational position of the driven side rotational member relative to the driving side rotational member and properly control the opening and closing timing of an intake valve immediately after the start of the engine.

In JP 2003-278566A, a technology, which intends to control the valve timing control device properly at the start of the engine, is disclosed. A configuration which supplies the operational fluid during engine stopping to prevent the operational fluid from flowing out from the fluid pressure chambers of the valve timing control device while the engine is temporary stopped. This allows the valve timing control device to properly control the opening and closing timings of the intake valve at the start of the engine.

According to JP 2003-278566A, in addition to the hydraulic pump, an extra pump is required to supply the operational fluid during the engine stopping. Consequently, the configuration of the valve timing control device becomes complicated, and weight of the vehicle is increased.

A certain amount of time has elapsed since the engine started, then the viscosity of the operational fluid becomes high and it is not possible to supply the operational fluid to a desired area promptly. In order to lower the viscosity of the operational fluid, it is necessary to raise the temperature, however it needs a certain amount of time.

The present invention has been made in view of the above circumstances, and provides a valve timing control device which is able to supply the high viscosity operational fluid in a short time and perform the opening and closing timing control of the valves at a proper timing with a simple configuration.

SUMMARY OF THE INVENTION

According to an aspect of the present invention, a valve timing control device includes a driving side rotational member synchronously rotating with a crankshaft of an internal combustion engine, a driven side rotational member arranged coaxially with the driving side rotational member and rotatable relative to the driving side rotational member, the driven side rotational member rotating integrally with a camshaft for opening and closing valves for the internal combustion engine, a retarded angle chamber formed by the driving side rotational member and the driven side rotational member and displacing a relative rotational phase of the driven side rotational member relative to the driving side rotational member in a retarded angle direction, an advanced angle chamber formed by the driving side rotational member and the driven side rotational member and displacing the relative rotational phase of the driven side rotational member relative to the driving side rotational member in an advanced angle direction, a first control valve controlling supply and discharge states of an operational fluid between an operational fluid reservoir provided at a lower portion of the internal combustion engine and the advanced angle chamber and the retarded angle chamber, a supply passage supplying the operational fluid from the operational fluid reservoir to the first control valve, a first pump provided at the supply passage and pumping the operational fluid in the operational fluid reservoir to a vapor liquid separating portion, a second pump provided at the supply passage and pumping the operation fluid in the vapor liquid separating portion to the first control valve, a discharge passage discharging the operational fluid from the first change valve toward the operational fluid reservoir; and a second control valve provided at the discharge passage and operated to selectively switch the discharge passage between a first discharge passage discharging the operational fluid discharged from the first change valve to the operational fluid reservoir and a second discharge passage flowing the operational fluid to be drawn into a drawing portion of the first pump.

According to another aspect of the present invention, a valve timing control device includes a driving side rotational member synchronously rotating with a crankshaft of an internal combustion engine, a driven side rotational member arranged coaxially with the driving side rotational member and rotatable relative to the driving side rotational member, the driven side rotational member rotating integrally with a camshaft for opening and closing valves for the internal combustion engine, a retarded angle chamber formed by the driving side rotational member and the driven side rotational member and displacing a relative rotational phase of the driven side rotational member relative to the driving side rotational member in a retarded angle direction, an advanced angle chamber formed by the driving side rotational member and the driven side rotational member and displacing the relative rotational phase of the driven side rotational member relative to the driving side rotational member in an advanced angle direction, a first change valve controlling supply and discharge states of an operational fluid between an operational fluid reservoir provided at a lower portion of the internal combustion engine and the advanced angle chamber and the retarded angle chamber, a supply passage supplying the operational fluid from the operational fluid reservoir to the first change valve, a pump provided at the supply passage and supplying the operation fluid in the operational fluid reservoir to the first change valve, a discharge passage discharging the operational fluid from the first change valve toward the operational fluid reservoir; and a second control valve provided at the discharge passage and operated to selectively switch the discharge passage between a first discharge passage discharging the operational fluid discharged from the first change valve to the operational fluid reservoir and a second discharge passage flowing the operational fluid to be drawn into a drawing portion of the first pump.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
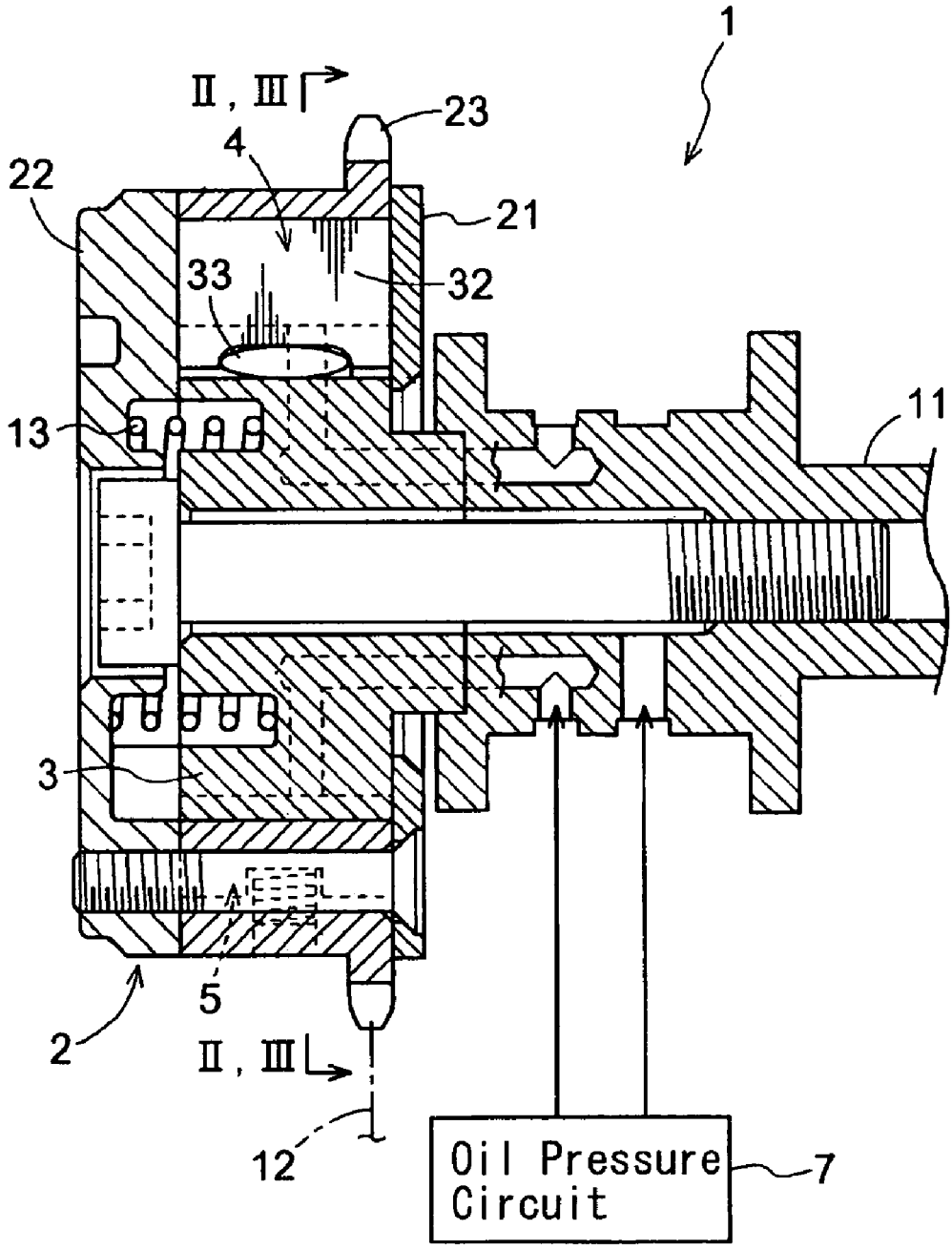
FIG. 1 is a sectional side view illustrating an entire configuration of a valve timing control device 1 according to the invention.
Figure 2:
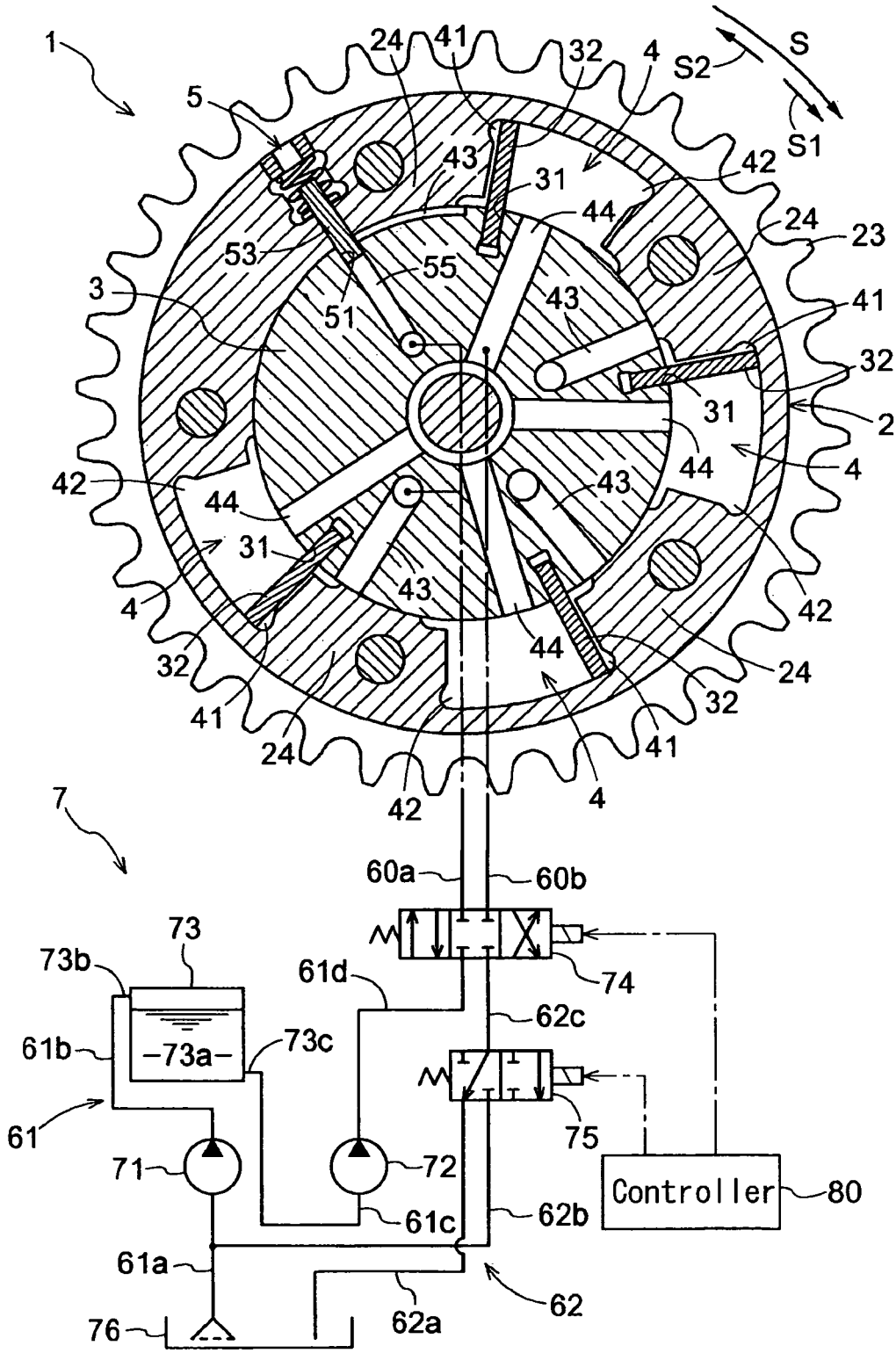
FIG. 2 is a view illustrating the cross section taken along a line II-II of FIG. 1 and an oil pressure circuit in detail.
Figure 3:
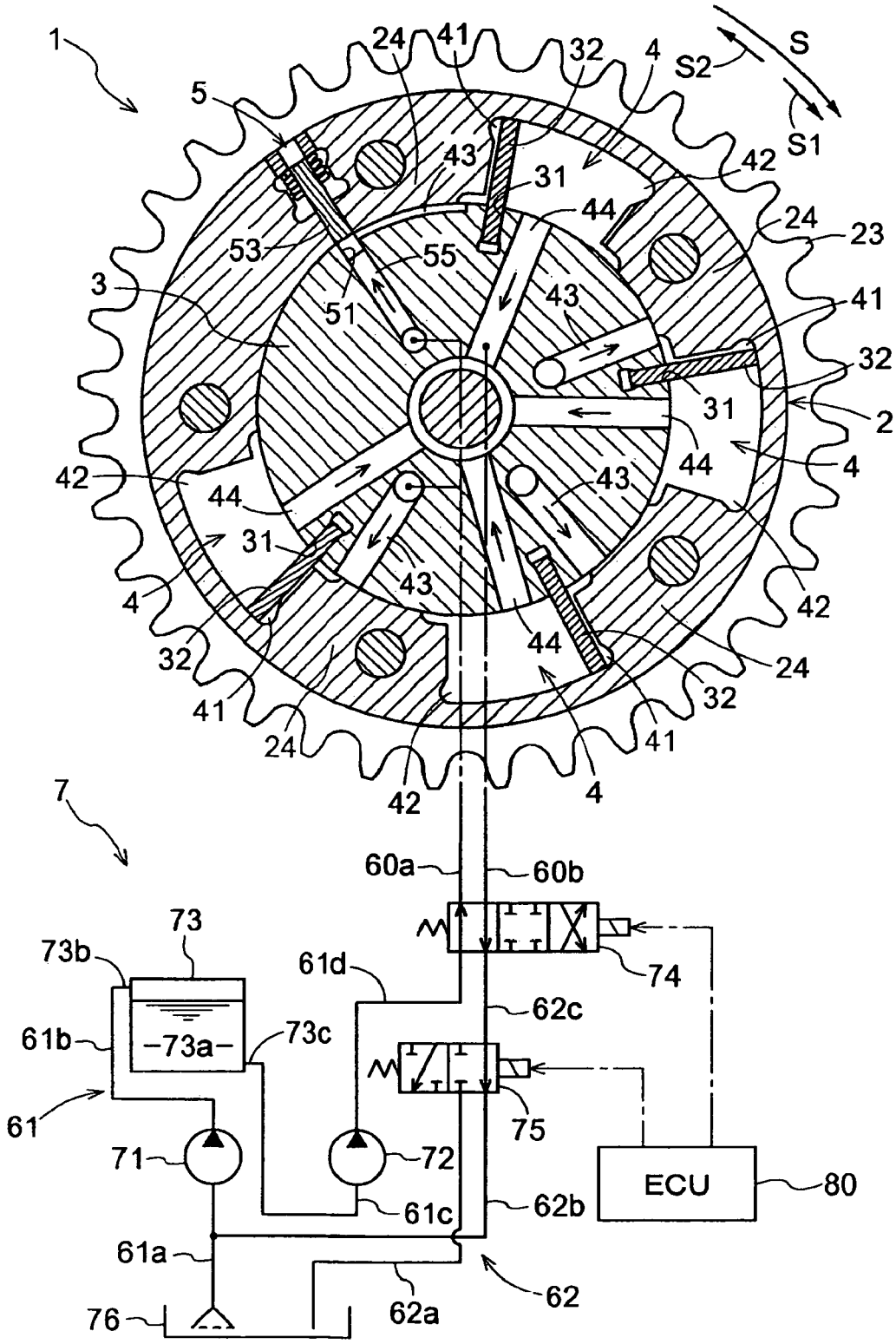
FIG. 3 is a view illustrating the cross section taken along a line III-III of FIG. 1 and the oil pressure circuit in detail.

Embodiments of the present invention will be described below with reference to the attached drawings. FIG. 1 is a sectional side view illustrating an entire configuration of a valve timing control device 1. FIG. 2 is a view illustrating a cross section taken along a line II-II of FIG. 1 and FIG. 3 is a view illustrating a cross section taken along the line III-III of FIG. 1.

The valve timing control device 1 can be mounted on a vehicle provided with only an engine as an internal combustion engine 10 as a driving means or a hybrid type vehicle provided with a driving means having an engine and an electric motor. Thus, the valve timing control device 1 is a device which controls an opening and closing timing of valves 14 relative to the driving means having at least the engine from among the above described components (i.e. the engine and the electric motor.).

The valve timing control device 1 according to the embodiment includes an external rotor 2 serving as a driving side rotational member rotating synchronously with a crankshaft 9 of an engine, and an internal rotor 3 serving as a driven side rotational member integrally rotating with a camshaft 11 for opening and closing valves 14 of the engine.

The internal rotor 3 is integrally assembled to a distal end portion of the camshaft 11 serving as a rotational shaft of a cam for controlling opening and closing of an intake valve or an exhaust valve of the engine. The internal rotor 3 is fitted so as to be coaxially arranged and relatively rotatable within a range of a predetermined relative rotation relative to the external rotor 2. A rear plate 21 is unitarily assembled to the external rotor 2 at a side where the camshaft 11 is connected and a front plate 22 is unitarily assembled to the external rotor 2 at an opposite side where the camshaft 11 is connected. A timing sprocket 23 is formed at an external periphery of the external rotor 2. A power transmission member 12 such as a timing chain and a timing belt is extended between the timing sprocket 23 and a gear attached to the crankshaft 9 of the engine.

Upon rotation of the engine crankshaft 9, a rotational force is transmitted to the timing sprocket 23 via the power transmission member 12, the external rotor 2 rotates along a rotational direction S shown in FIG. 2. In response to the rotation, the internal rotor 3 rotates along the rotational direction S to rotate the camshaft 11, and a cam provided at the camshaft 11 pushes the intake valve or the exhaust valve down to open the valve.

As shown in FIG. 2, plural projections 24 each serving as a shoe projected in a radially inner direction are arranged on the external rotor 2 having intervals from each other along the rotational direction. A fluid pressure chamber 4 defined by the external rotor 2 and the internal rotor 3 is formed between adjacent projections 24 of the external rotor 2. For example, four fluid pressure chambers 4 are formed according to the embodiment of the present invention.

A vane groove 31 is formed on an external periphery portion of the internal rotor 3 facing each fluid pressure chamber 4. A vane 32 for defining the fluid pressure chamber 4 into an advanced angle chamber 41 and a retarded angle chamber 42 in a relative rotational direction (i.e. in the direction of arrows S1, S2 of FIG. 2) is slidably located in the vane groove 31 along a radial direction. The vane 32 is biased radially outward by means of a spring 33 provided at an inner radial side of the vane 32.

Volume of the advanced angle chamber 41 becomes larger by the injection of the operational fluid, and then the relative rotational phase of the internal rotor 3 relative to the external rotor 2 is displaced to an advanced angle direction (arrow S1 of FIG. 2). Volume of the retarded angle chamber 42 becomes larger by the injection of the operational fluid, and then the relative rotational phase of the internal rotor 3 relative to the external rotor 2 is displaced to a retarded angle direction (arrow S2 of FIG. 2). For the operational fluid, an operational oil such as a lubricating oil can be used. Viscosity of the operational oil is usually high, and resistance of the flow passage is large before the engine starts driving, i.e. before circulating in a predetermined passage. Temperature of the operational oil rises, and the viscosity becomes low by circulating the predetermined passage after the engine starts driving. At this point, the resistance of the flow passage, which occurred when the operational oil flows down, is lowered. Hereinafter, the operational fluid is referred as the operational oil.

The advanced angle chamber 41 of each fluid pressure chamber 4 is in communication with an advanced angle passage 43 formed on the internal rotor 3, the retarded angle chamber 42 is in communication with a retarded angle passage 44 formed on the internal rotor 3, and the advanced angle passage 43 and the retarded angle passage 44 are connected to an oil pressure circuit 7 described below.

As illustrated in FIG. 2, out of the four advanced angle chambers, the advanced angle passage 43 of the advanced angle chamber 41 adjacently positioned to a lock mechanism 5 is a passage formed along a sliding surface of the internal rotor 3 with the external rotor 2 so that an engaging recessed portion 51 of the lock mechanism 5 is in communication with the advanced angle chamber 41, and the advanced angle passage 43 is in communication with the oil pressure circuit 7 via a lock passage 55. The lock mechanism 5 is structured between the internal rotor 3 and the external rotor 2 so as to be able to restrict the displacement of the relative rotational phase of the internal rotor 3 relative to the external rotor 2 at a predetermined lock phase by a lock member 53.

The operational oil is supplied or discharged into either or both the advanced angle chambers 41 or/and the retarded angle chambers 42 from the oil pressure circuit 7, and thus the relative rotational phase of the internal rotor 3 is displaced relative to the external rotor 2 in the direction of one of the advanced angle direction S1 and the retarded angle direction S2, or a biasing force is generated to hold the relative rotational phase at a arbitrary phase.

A range where the relative rotation phase of the internal rotor 3 relative to the external rotor 2 is able to displace corresponds to a range where the vane 32 is able to displace in the fluid pressure chamber 4, i.e. a range positioned between the most advanced angle phase and the most retarded angle phase.

As illustrated in FIG. 1, a torsion spring 13 is provided between the internal rotor 3 and the front plate 22 fixed to the external rotor 2. Both end portions of the torsion spring 13 are held at supporting portions formed in the internal rotor 3 and the external rotor 2 respectively. The torsion spring 13 provides a torque which is constantly biasing the internal rotor 3 and the external rotor 3 in the direction which the relative rotational phase is displaced in the advanced angle direction S1.

<Oil Pressure Circuit>

Next, the configuration of the oil pressure circuit 7 is described. (refer to FIG. 2 and FIG. 3). The oil pressure circuit 7 is provided with a first change valve (first change valve) 74, which controls the supply and the discharge states of the operational oil between an operational fluid reservoir 76 provided at a lower portion of the internal combustion engine 10 and the advanced angle chamber and the retarded angle chamber. An oil passage 60*a* and an oil passage 60*b* are connected to the first change valve 74. The oil passages 60*a* and 60*b* are connected to the advanced angle passage 43 and the retarded angle passage 44 respectively. Thus, the first change valve 74 is in communication with the fluid pressure chambers 4.

The oil pressure circuit 7 is provided with a supply passage 61 and a discharge passage 62. The supply passage 61 supplies the operational oil from the operational fluid reservoir 76 to the first change valve 74, and the discharge passage 62 discharges the operational oil from the first change valve 74 toward the operational fluid reservoir 76.

The supply passage 61 is provided with the first pump 71 and the second pump 72. The first pump 71 pumps the operational oil of the operational fluid reservoir 76 to a vapor liquid separating portion 73, and the second pump 72 supplies the operational oil reserved in the vapor liquid separating portion 73 to the first change valve 74. On the other hand, the discharge passage 62 is provided with a first discharge passage 62*a* and a second discharge passage 62*b*. The first discharge passage 62*a* discharges the operational oil discharged from the first change valve 74 to the operational fluid reservoir 76, and the second discharge passage 62*b* flows the operational oil, which is discharged from the first change valve 74, into the drawing portion of the first pump 71. Further, the discharge passage 62 is provided with a second change valve (second control valve) 75, which selectively switches the discharge passage between the first discharge passage 62*a* and the second discharge passage 62*b*.

The first change valve 74 is connected with the second change valve 75 by an oil passage 62*c*, and the first and second change valves 74 and 75 are controlled by a controller 80 (controlling means).

(Hydraulic Pump)

In the embodiment, the first and second pumps 71 and 72 are hydromechanical pumps driven by transmission of a driving force of the crankshaft 9 of the engine.

The first pump 71 draws the operational oil reserved in the operational fluid reservoir 76 from a drawing portion via the oil passage 61*a* and also draws the operational oil from the first change valve 74 via the second discharge passage 62*b* by switching the state of the second change valve 75. Then, the first pump 71 discharges the drawn operational oil to the vapor liquid separating portion 73 via the oil passage 61*b*.

The second pump 72 draws the operational oil coming from the vapor liquid separating portion 73 via oil passage 61*c* from a drawing portion to supply the operational oil to the fluid pressure chambers 4 via the oil passage 61*d*, the first change valve 74, and one of the oil passage 60*a* and the oil passage 60*b*.

(Vapor Liquid Separating Portion)

The liquid surface level of the operational oil reserved in the operational fluid reservoir 76 moves up and down due to vibration caused by driving of a vehicle. Therefore, a lower end of the oil passage 61*a* is in either one of two states. In one state, the lower end of the oil passage 61*a* reaches the liquid surface. In the other state, the lower end of the oil passage 61*a* does not reach the liquid surface. In that case, if the operational oil is drawn by the first pump 71, air comes to be mixed with the operational oil. If the operational oil is supplied to the fluid pressure chambers 4 being mixed with air, the lubrication property is lowered in the fluid pressure chambers 4 to cause inconveniences. Thus, it is necessary to separate the operational oil from the mixed air before supplying the operational oil to the fluid pressure chambers 4.

The vapor liquid separating portion 73 is provided between the first pump 71 and the second pump 72 and has a reservoir chamber 73*a* where a certain amount of the operational oil can be reserved. The vapor and liquid separating portion 73 has the first communicating hole 73*b* and the second communicating hole 73*c*. The first communicating hole 73*b* connects the reservoir chamber 73*a* with the oil passage 61*b*. The second communicating hole 73*c* is provided at a lower position compared to the first communicating hole 73*b* and connects the reservoir chamber 73*a* with the oil passage 61*c*.

In other words, the operational oil being mixed with air is separated from air in the reservoir chamber 73*a*, and only the operational oil is flowed out from the second communicating hole 73*c* where air is not mixed to the oil. Therefore, the operational oil separated from air, is supplied to the fluid pressure chambers 4.

(The First Change Valve)

As for the first change valve 74, for example, a variable electromagnetic spool valve, can be used. The variable electromagnetic spool valve displaces a spool, which is slidably disposed in a sleeve, against a spring by energization from the controller 80 to a solenoid.

The first change valve 74 has an advanced angle port, a retarded angle port, a supply port, and a discharge port. The advanced angle port is in communication with the advanced angle passage 43 and the lock passage 55, the retarded angle port is in communication with the retarded angle passage 44, the supply port is in communication with a flow passage positioned at a downstream of the second pump 72, and the discharge port is in communication with a flow passage positioned at an upstream of the second change valve 75.

The first change valve 74 is a three position control valve which is able to perform three mode control. One of the three modes is advanced angle control (refer to FIG. 3) in which the advanced angle port is communicated with the supply port and the retarded angle port is communicated with the discharge port. The second mode is retarded angle control in which the retarded angle port is in communication with the supply port and the advanced angle port is in communication with the discharge port. The other mode is hold control (refer to FIG. 2) in which the advanced port and the retarded port are blocked.

The first change valve 74 controls the supply or the discharge of the operational fluid to the advanced angle chambers 41 and the engaging recessed portion 51 of the lock mechanism 5, or the retarded angle chambers 42 by operating under the control of the controller 80. Thus, the first change valve 74 controls the switching between a lock state and a released state of the lock mechanism 5 and the relative rotational phase of the internal rotor 3 relative to the external rotor 2.

(The Second Change Valve)

For the second change valve 75, as in the case of the first change valve 74, a variable electromagnetic spool valve can be used. The second change valve 75 has a discharge port, a drawing port and a drain port. The discharge port is in communication with a flow passage positioned at a downstream of the first change valve 74, the drawing port is in communication with a flow passage positioned at an upstream of the first pump 71, and the drain port is in communication with the operational fluid reservoir 76.

The second change valve 75 is a two position control valve which is able to perform two mode control. One of the modes is drawing control (refer to FIG. 3), in which the discharge port is in communication with the drawing port. The other mode is drain control (refer to FIG. 2) in which the discharge port is in communication with the drain port.

The second change valve 75 controls the supply of the operational fluid to the fluid pressure chambers 4 via the second discharge passage 62*b*, the first pump 71, the vapor liquid separating portion 73, and the second pump 72, and also controls the discharge of the operational fluid to the operational fluid reservoir 76 via the first discharge passage 62*a* by being operating under the control of the controller 80.

(Controller)

The controller (ECU) 80 performs the operational control of the first change valve 74 and the second change valve 75. The controller 80 utilizes an arithmetic processing unit. The controller 80 controls an operation of the engine based on an operation approving command or an operation stopping command input. That is to say, the controller 80 put the engine into the operational state after the operation approving command is received. When the engine is in the operational state and the driving operation such as an accelerating operation is preformed, the controller 80 controls the engine in response to the driving operation. Furthermore, the controller 80 puts the engine into the unoperational state after the operation stopping command is received.

The controller 80 switches the discharge passage 62 to the second discharge passage 62*b* immediately after the start of the engine and then controls the second change valve 75 to switch the second discharge passage 62*b* to the first discharge passage 62*a* once the predetermined condition is satisfied after the engine starts.

(Switching the Discharge Passage by the Second Change Valve)

When the engine is stopped, the operational oil is not supplied to the fluid pressure chambers 4. Consequently, the operational oil flows from the fluid pressure chambers 4 by its own weight, and then the operational oil is reserved in the operational fluid reservoir 76 or the vapor-liquid separating portion 73. The temperature of the operational oil is lowered and the viscosity of the oil is high at this point.

In this state, the resistance of the flow passage of the operational oil is large, and thus it is time-consuming to supply the operational oil into the fluid pressure chambers 4 via the oil passage of the oil pressure circuit. Therefore, it is difficult to smoothly control the relative rotational phase of the internal rotor 3 relative to the external rotor 2 immediately after the start of the engine and also difficult to properly control the opening or closing timing of the intake valve. In order to avoid the situation, the valve timing control device 1 of this embodiment is configured so as to supply the high viscosity operational oil to the fluid pressure chambers 4 in a short time.

After the engine starts and the operating approving command is input to the controller 80, the first and second pumps 71 and 72 are driven. At the same time, the controller 80 controls the second change valve 75 to switch the discharge passage 62 to the second discharge passage 62*b* immediately after the start of the engine. In other words, the first change valve 74 is put into the advanced angle control state and the second change valve 75 is put into the drawing control state by the commands from the controller 80 (refer to FIG. 3). The retarded angle chambers 42, the retarded angle passages 44, the first change valve 74, the second change valve 75 and the second discharge passage 62*b* come to be in communication by driving of the first pump 1 and vacuum pressure is generated in the inside of the above components.

Each fluid pressure chamber 4 is divided into the advanced angle chamber 41 and the retarded angle chamber 42 by the vane 32. However, the advanced angle chamber 41 and the retarded angle chamber 42 are not airtightly divided by the vane 32. Hence, when the passages ranging from the second discharge passage 62*b* to the retarded chambers 42 are drawn by the first pump 71, the vacuum pressure is generated in the advanced angle chambers 41, which is slightly in communication with the retarded angle chambers 42. The advanced angle chambers 41 are connected with the operational fluid reservoir 76 via the advanced angle passage 43, the first change valve 74, the second pump 72, the vapor liquid separating portion 73 and the first pump 71. Therefore, when the first pump 71 starts the operation, the operational oil, which is discharged from the second pump 72 via the first change valve 74, more easily flows into the advanced angle chambers 41 or the retarded angle chambers 42.

That is, immediately after the start of the engine, even if the viscosity of the operational oil is in high state, influence of the increased resistance of the operational oil against the flow passage can be reduced by generating the vacuum pressure in the second discharge passage 62*b* when the operational oil is circulated in the valve timing control device 1. Thus, the operational fluid can be supplied promptly to the inside of the advanced angle chambers 41 or the retarded angle chambers 42, and the valve timing control device 1 is able to perform the control at an proper timing with a simple configuration.

Once the predetermined condition is satisfied after the engine starts, the second change valve 75 is controlled by the controller 80 so as to switch the discharge passage 62 to the first discharge passage 62*a*. At this time, the second change valve 75 is converted from the drawing control to the drain control by the command of the controller 80, and the operational oil is discharged to the operational fluid reservoir 76 via the first discharge passage 62*a*.

In other words, for example, the temperature of the operational oil rises to 60-80 degrees Celsius by a warming up operation following the start of the engine, the viscosity of the operational oil is lowered. Consequently, the resistance of the flow passage is lowered. At this point, the operational oil is smoothly supplied without the control to generate the vacuum pressure in the second discharge passage 62*b* by the first pump 71. Thus, the discharge passage 62 is switched to the first discharge passage 62*a*, which is usually used. In this manner, it is possible to select an appropriate passage based on the state of the operational oil by controlling the second change valve 75 by means of the controller 80.

The predetermined condition may be, for example, the temperature of at least one of the operational oil and an engine coolant, which is preliminarily set. If the second change valve 75 is controlled based on the temperature of the operational oil to be flowed, it is possible to perceive the viscosity of the operational oil in the most certain way and control the second change valve 75 for switching at an appropriate timing. Alternatively, if the control is performed based on the temperature of the coolant, it is possible to indirectly perceive the viscosity of the operational oil without adding any particular equipments because a thermometer of the coolant is provided at nearly every vehicle. Therefore, it is also possible to control the second change valve 75 for switching at the appropriate timing.

The temperature of the operational oil is measured by an operational oil measuring means (not shown) provided at the flow passage where the operational oil flows down. On the other hand, the temperature of the coolant is measured by a coolant measuring means (not shown) provided at the flow passage where the coolant flows down. The measuring means are configured so that at least one result of the temperature measurements of the operational oil and the coolant is sent to the controller 80.

The predetermined condition may be a time period which is preliminarily set. That is, the device determines if the temperature of the operational oil rises to lower the viscosity and the resistance of the flow passage is lowered based on the time period that is elapsed since the engine start. More specifically, as the usage of the individual vehicle does not significantly vary, for example, the ending time of the warming up operation may be preliminary set based on an area where the vehicle is used. It is a relatively simple means to control based upon the time period and it is possible to switch the second change valve 75 at the appropriate timing.

ANOTHER EMBODIMENT 1

In the aforementioned embodiment, the controller 80 controls the second change valve 75 to switch the discharge passage 62 to the second discharge passage 62*b* immediately after the start of the engine. For instance, while the vehicle has been driven at a high speed, the response speed of the valve timing control device 1 is expected to be faster than that of normal speed operation. Under the circumstances, when a predetermined time period is elapsed since the engine started, the second change valve 75 may be controlled so as to switch the discharge passage 62 to the second discharge passage 62*b*. In this case, the predetermined time period has elapsed since the engine started, and the temperature of the operational oil has risen to some extent. Thus, the resistance of the flow passage is low. Furthermore, the second discharge passage 62*b* is drawn by the first pump 71 so as to generate the vacuum pressure therein. Therefore, it is possible to supply the operational oil to the inside of the fluid pressure chambers 4 promptly.

ANOTHER EMBODIMENT 2

Figure 4:
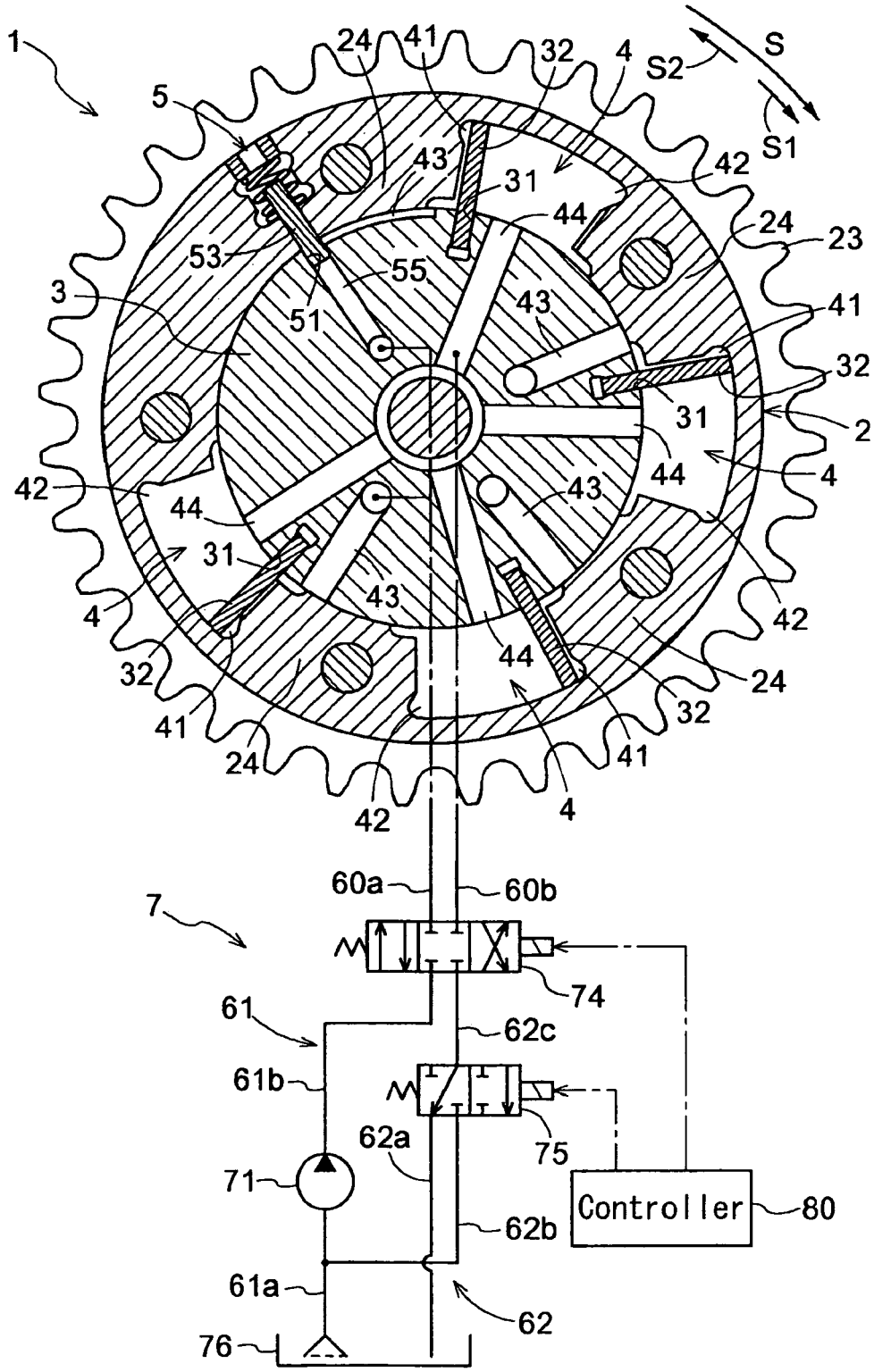
FIG. 4 is a view illustrating an oil pressure circuit of another embodiment.
Figure 5:
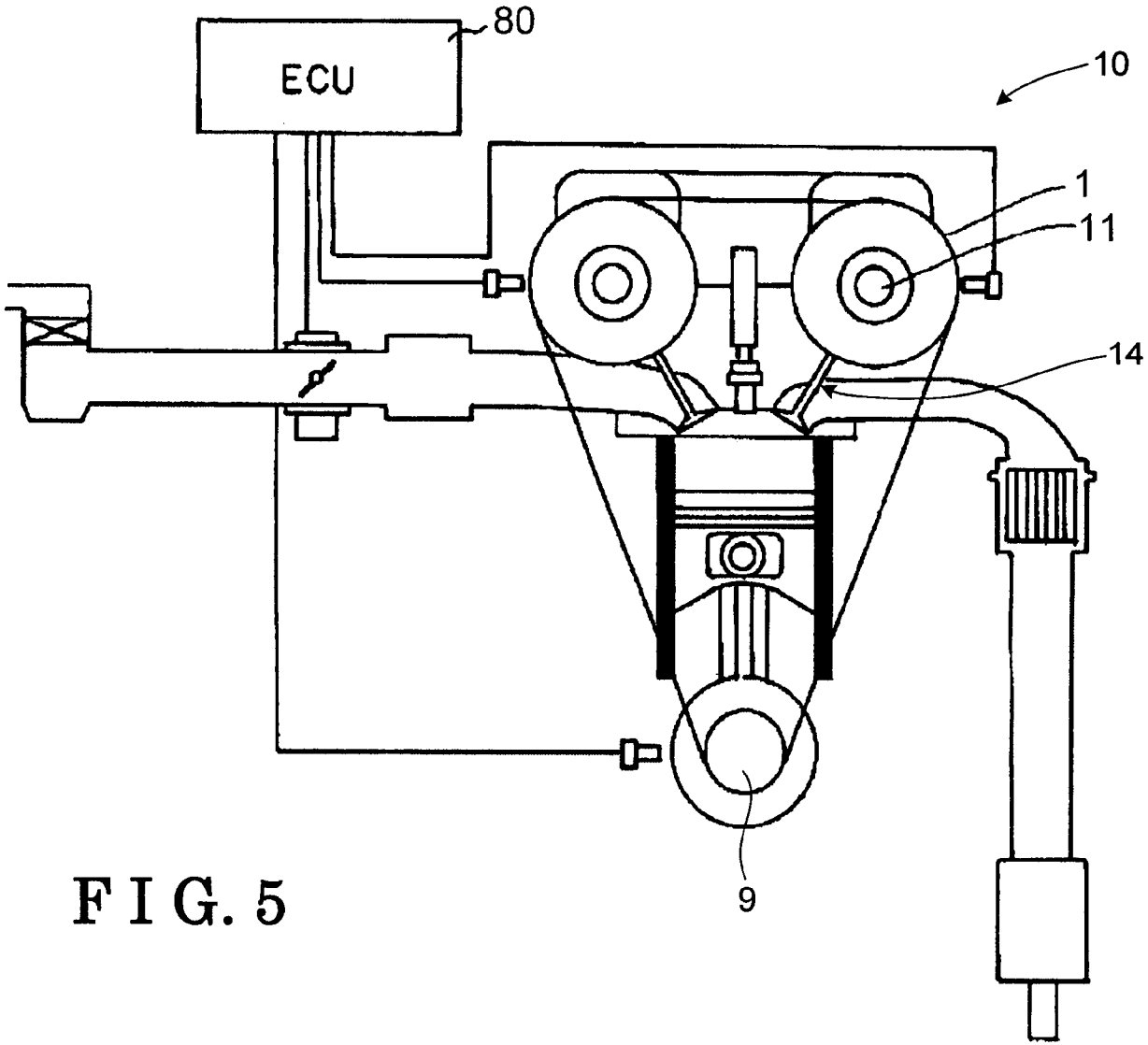
FIG. 5 is a view illustrating the configuration of the valve timing control device according to the embodiments of the invention.

In the aforementioned embodiment, the configuration, which uses the two pumps, is employed, however, the configuration may not be limited to this way. For example, as illustrated in FIG. 4, the configuration, which uses a pump and does not have the vapor liquid separating portion 73, may be employed.

In other words, the pump 71, which supplies the operational oil of the operational fluid reservoir 76 to the first change valve 74, is provided at the supply passage 61. On the other hand, the second change valve 75 is provided at the discharge passage 62 and operated to selectively switch the discharge passage between the first discharge passage 62*a* and the second discharge passage 62*b*. The first discharge passage 62*a* discharges the operational oil discharged from the first change valve 74 to the operational fluid reservoir 76, and the second discharge passage 62*b* flows the operational oil discharged from the first change valve 74 to be drawn into the drawing portion of the pump 71.

Thus, the number of the pump is decreased compared to the aforementioned embodiment and the vapor liquid separating portion 73 is not formed. Therefore, the configuration of the oil pressure circuit 7 can be simplified. As in the case of the aforementioned embodiment, the pump is a hydromechanical pump which is driven by the transmission of the driving force of the crankshaft 9 of the engine. The other configuration is identical to that of the aforementioned embodiment.

If the operational oil of the operational fluid reservoir 76 is drawn by the pump 71 immediately after the start of the engine, the operational oil is circulated among the fluid pressure chambers 4, the oil passage 60*b* and the first change valve 74. The operational oil is disappeared from the inside of the fluid pressure chambers 4 when the engine is stopped, and it requires a certain amount of time to fill the supply passage 61 and the discharge passage 62 with the operational oil. Therefore, the second change valve 75 is controlled so as to switch the discharge passage 62 to the first discharge passage 62*a* immediately after the start of the engine until eliminating the air existing in the discharge passage 62.

Once the predetermined condition is satisfied after the engine starts, the second change valve 75 is controlled so as to switch the discharge passage 62 to the second discharge passage 62*b*. As described above, the passages ranging from the second discharge passage 62*b* to the retarded angle chamber 42 is drawn by the pump 71 after eliminating the air existing in the fluid pressure chambers 4 immediately after the start of the engine.

After that, once the second predetermined condition is satisfied since the engine starts, the second change valve 75 is controlled so as to switch to the first discharge passage 62*a*.

As for the second predetermined condition, as in the case of the first embodiment, both time and temperature are applicable.

This invention can be applied to the valve timing control device having the first change valve controlling the supply and the discharge states of the operational fluid among the advanced angle chambers, the retarded angle chambers, the operational fluid reservoir provided at the internal combustion engine 10.

The first configuration characteristic of the valve timing control device is including a driving side rotational member synchronously rotating with a crankshaft of an internal combustion engine, a driven side rotational member arranged coaxially with the driving side rotational member and rotatable relative to the driving side rotational member, the driven side rotational member rotating integrally with a camshaft for opening and closing valves for the internal combustion engine, a retarded angle chamber formed by the driving side rotational member and the driven side rotational member and displacing a relative rotational phase of the driven side rotational member relative to the driving side rotational member in a retarded angle direction, an advanced angle chamber formed by the driving side rotational member and the driven side rotational member and displacing the relative rotational phase of the driven side rotational member relative to the driving side rotational member in an advanced angle direction, a first change valve controlling supply and discharge states of an operational fluid between an operational fluid reservoir provided at a lower portion of the internal combustion engine and the advanced angle chamber and the retarded angle chamber, a supply passage supplying the operational fluid from the operational fluid reservoir to the first change valve, a first pump provided at the supply passage and pumping the operational fluid in the operational fluid reservoir to a vapor liquid separating portion, a second pump provided at the supply passage and pumping the operation fluid in the vapor liquid separating portion to the first change valve, a discharge passage discharging the operational fluid from the first change valve toward the operational fluid reservoir; and a second change valve provided at the discharge passage and operated to selectively switch the discharge passage between a first discharge passage discharging the operational fluid discharged from the first change valve to the operational fluid reservoir and a second discharge passage flowing the operational fluid to be drawn into a drawing portion of the first pump.

According to the configuration, when the discharge passage is switched to the second discharge passage by the second change valve, the second discharge passage is drawn by the first pump to generate the vacuum pressure therein. At this time, the vacuum pressure is also generated in the advanced chambers or the retarded chambers, which are in communication with the second discharge passage via the first change valve. Therefore, when the first pump starts the operation, the operational fluid discharged from the second pump via the first change valve more easily flows into the advanced angle chambers or the retarded angle chambers.

That is, even if the viscosity of the operational oil is high, influence of the increased resistance of the flow passage against the operational fluid can be reduced by generating the vacuum pressure in the second discharge passage when the operational oil is circulated in the valve timing control device 1. Thus, the operational fluid can be supplied promptly to the inside of the advanced angle chambers or the retarded angle chambers, and the valve timing control device is able to perform the control at the proper timing with a simple configuration.

In this configuration, only the second change valve and the second discharge passage need to be added. Thus, the configuration of the valve timing control device can be simplified.

The second configuration characteristic of the valve timing control device is including the controller controlling the second change valve to switch the discharge passage to the second discharge passage immediately after the start of the internal combustion engine and switch the discharge passage to the first discharge passage once the predetermined condition is satisfied after the engine starts.

According to the second configuration characteristic, the control of the second change valve is performed in two steps. Usually, the temperature of the operational fluid is low and the viscosity is high immediately after the start of the internal combustion engine. At this point, the second change valve is controlled to generate the vacuum pressure in the second discharge passage by the first pump. Thus, it is possible to supply the operational fluid into the inside of the advanced angle chambers or the retarded angle chambers promptly, even if the viscosity of the operational fluid is high. On the other hand, once the predetermined condition is satisfied after the engine starts, the temperature of the operational fluid is risen and the viscosity becomes low. In this case, the operational fluid is smoothly supplied into the advanced angle chambers or the retarded angle chambers without the control for generating the vacuum pressure in the second discharge passage by the first pump. Consequently, the discharge passage is switched to the first discharge passage which is normally used.

Therefore, according to the configuration, it is possible to select the proper passage based on the state of the operational fluid and control the opening and closing timings of the valves immediately after the start of the internal combustion engine.

The third characteristic of the valve timing control device is including a driving side rotational member synchronously rotating with a crankshaft of an internal combustion engine, a driven side rotational member arranged coaxially with the driving side rotational member and rotatable relative to the driving side rotational member, the driven side rotational member rotating integrally with a camshaft for opening and closing valves for the internal combustion engine, a retarded angle chamber formed by the driving side rotational member and the driven side rotational member and displacing a relative rotational phase of the driven side rotational member relative to the driving side rotational member in a retarded angle direction, an advanced angle chamber formed by the driving side rotational member and the driven side rotational member and displacing the relative rotational phase of the driven side rotational member relative to the driving side rotational member in an advanced angle direction, a first change valve controlling supply and discharge states of an operational fluid between an operational fluid reservoir provided at a lower portion of the internal combustion engine and the advanced angle chambers and the retarded angle chambers, a supply passage supplying the operational fluid from the operational fluid reservoir to the first change valve, a pump provided at the supply passage and supplying the operation fluid in the operational fluid reservoir to the first change valve, a discharge passage discharging the operational fluid from the first change valve toward the operational fluid reservoir and a second change valve provided at the discharge passage and operated to selectively switch the discharge passage between a first discharge passage discharging the operational fluid discharged from the first change valve to the operational fluid reservoir and a second discharge passage flowing the operational fluid to be drawn into a drawing portion of the first pump.

According to the third configuration characteristic of the valve timing control device, when the discharge passage is switched to the second discharge passage by the second change valve, the vacuum pressure is generated in the second discharge passage. Consequently, the pump starts the operation, then the operational fluid discharged via the first change valve flows into the advanced angle chambers or the retarded angle chambers more easily.

That is, even if the viscosity of the operational oil is high, influence of the increased resistance of the operational oil against the flow passage can be reduced by generating the vacuum pressure in the second discharge passage when the operational oil is circulated in the valve timing control device 1. Thus, the operational fluid can be supplied promptly to the inside of the advanced angle chambers or the retarded angle chambers, and the valve timing control device is able to perform the control at the proper timing with a simple configuration.

Particularly, in the configuration, one pump is included and the vapor liquid separating portion, which is illustrated in the first configuration characteristic, is not provided. Only the second change valve and the second discharge passage need to be added. Thus, the configuration of the valve timing control device can be simpler.

The fourth configuration characteristic of the valve timing control device is including the controller controlling the second change valve to switch the discharge passage to the first discharge passage immediately after the start of the internal combustion engine and switch the discharge passage to the second discharge passage once the predetermined condition is satisfied after the engine starts.

According to the fourth configuration characteristic, the control of the second change valve is performed in two steps. The operational fluid disappeared from the advanced angle chambers and the retarded angle chambers during the engine stopping. Thus, the second change valve is controlled so as to switch the discharge passage to the first discharge passage immediately after the start of the internal combustion engine to connect the first discharge passage with the operational fluid reservoir. Thus, it is possible to completely eliminate the air existing in the advanced angle chambers and the retarded angle chambers.

Once the precondition is satisfied after the start of the engine, the second change valve is controlled so as to switch the discharge passage to the second discharge passage. At this point, even if the temperature of the operational fluid is not adequately risen and the viscosity is high, the increased resistance of the fluid passage can be reduced by generating the vacuum pressure in the second discharge passage. Thus it is possible to supply the operational oil to the inside of the advanced angle chambers or the retarded angle chambers. On the other hand, if the temperature of the operation fluid is adequately risen and the viscosity is low, it is possible to supply the operational fluid more promptly to improve the response speed of the valve timing control device.

The fifth configuration characteristic of the valve timing control device is that the predetermined condition is a temperature of at least one of the operational fluid and the coolant of the internal combustion engine. The temperature is preliminary set.

According to the fifth configuration characteristic, the criterion to determine if the operational fluid is in the state which allows the operational fluid to be promptly supplied into the advanced chambers or the retarded chambers is the temperature of the operational fluid. In this manner, the criterion is set to the temperature of the operational oil, and thus it is possible to control the second change valve 75 for switching at the appropriate timing. Alternatively, if the criterion is set to the temperature of the coolant used for cooling down the internal combustion engine, then it is possible to indirectly perceive the temperature of the operational fluid based on the increased range of the coolant temperature.

The sixth configuration characteristic of the valve timing control device, the predetermined condition is the time period which is set preliminary.

According to the sixth configuration characteristic, the valve timing control device determines if the temperature of the operation fluid is adequately risen to lower the viscosity and the resistance of the flow passage is reduced based on the time period elapsed from the start of the internal combustion engine. Therefore, it is possible to control the second change valve for switching at the proper timing by adding a simple component such as a timer to the configuration.

The principles, of the preferred embodiments and mode of operation of the present invention have been described in the foregoing specification. However, the invention, which is intended to be protected, is not to be construed as limited to the particular embodiment disclosed. Further, the embodiment described herein are to be regarded as illustrative rather than restrictive. Variations and changes may be made by others, and equivalents employed, without departing from the spirit of the present invention. Accordingly, it is expressly intended that all such variations, changes and equivalents that fall within the spirit and scope of the present invention as defined in the claims, be embraced thereby.

The invention claimed is:

1. A valve timing control device, comprising:

a driving side rotational member synchronously rotating with a crankshaft of an internal combustion engine;

a driven side rotational member arranged coaxially with the driving side rotational member and rotatable relative to the driving side rotational member, the driven side rotational member rotating integrally with a camshaft for opening and closing valves for the internal combustion engine;

a retarded angle chamber formed by the driving side rotational member and the driven side rotational member and displacing a relative rotational phase of the driven side rotational member relative to the driving side rotational member in a retarded angle direction;

an advanced angle chamber formed by the driving side rotational member and the driven side rotational member and displacing the relative rotational phase of the driven side rotational member relative to the driving side rotational member in an advanced angle direction;

a first control valve controlling supply and discharge states of an operational fluid between an operational fluid reservoir provided at a lower portion of the internal combustion engine and the advanced angle chamber and the retarded angle chamber;

a supply passage supplying the operational fluid from the operational fluid reservoir to the first control valve;

a first pump provided at the supply passage and pumping the operational fluid in the operational fluid reservoir to a vapor liquid separating portion;

a second pump provided at the supply passage and pumping the operation fluid in the vapor liquid separating portion to the first control valve;

a discharge passage discharging the operational fluid from the first control valve toward the operational fluid reservoir; and a second control valve provided at the discharge passage and operated to selectively switch the discharge passage between a first discharge passage discharging the operational fluid discharged from the first control valve to the operational fluid reservoir and a second discharge passage flowing the operational fluid to be drawn into a drawing portion of the first pump.

2. A valve timing control device according to claim 1, further comprising:

a controlling means switching the discharge passage to the second discharge passage immediately after a start of the internal combustion engine and switching the discharge passage to the first discharge passage once a predetermined condition is satisfied after the engine starts.

3. A valve timing control device according to claim 2, wherein a predetermined condition is a temperature of either one of the operational fluid and a coolant of the internal combustion engine.

4. A valve timing control device according to claim 3, wherein the predetermined condition is a time period set preliminarily.

5. A valve timing control device, comprising:

a driving side rotational member synchronously rotating with a crankshaft of an internal combustion engine;

a driven side rotational member arranged coaxially with the driving side rotational member and rotatable relative to the driving side rotational member, the driven side rotational member rotating integrally with a camshaft for opening and closing valves for the internal combustion engine;

a retarded angle chamber formed by the driving side rotational member and the driven side rotational member and displacing a relative rotational phase of the driven side rotational member relative to the driving side rotational member in a retarded angle direction;

an advanced angle chamber formed by the driving side rotational member and the driven side rotational member and displacing the relative rotational phase of the driven side rotational member relative to the driving side rotational member in an advanced angle direction;

a first control valve controlling supply and discharge states of an operational fluid between an operational fluid reservoir provided at a lower portion of the internal combustion engine and the advanced angle chamber and the retarded angle chamber;

a supply passage supplying the operational fluid from the operational fluid reservoir to the first control valve;

a pump provided at the supply passage and supplying the operation fluid in the operational fluid reservoir to the first control valve;

a discharge passage discharging the operational fluid from the first control valve toward the operational fluid reservoir; and a second control valve provided at the discharge passage and operated to selectively switch the discharge passage between a first discharge passage discharging the operational fluid discharged from the first control valve to the operational fluid reservoir and a second discharge passage flowing the operational fluid to be drawn into a drawing portion of the pump.

6. A valve timing control device according to claim 5, further comprising a controlling means controlling the second control valve to switch the discharge passage to the second discharge passage immediately after a start of an internal combustion engine and switching the discharge passage to the first discharge passage once a predetermined condition is satisfied after the engine starts.

* * * * *